US011735114B2

(12) United States Patent
Zhao

(10) Patent No.: US 11,735,114 B2
(45) Date of Patent: Aug. 22, 2023

(54) PIXEL CIRCUIT, DRIVING METHOD THEREOF, AND DISPLAY DEVICE

(71) Applicant: KunShan Go-Visionox Opto-Electronics Co., Ltd, Jiangsu (CN)

(72) Inventor: Dongfang Zhao, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/717,427

(22) Filed: Apr. 11, 2022

(65) Prior Publication Data

US 2022/0230592 A1 Jul. 21, 2022

Related U.S. Application Data

(63) Continuation of application No. PCT/CN2021/082569, filed on Mar. 24, 2021.

(30) Foreign Application Priority Data

Apr. 20, 2020 (CN) ..... 202010312773.9

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0842;
(Continued)

(56) References Cited

U.S. PATENT DOCUMENTS 8,830,215 B2 * 9/2014 Ono ..... G06F 3/038 345/212
11,127,342 B2 * 9/2021 Feng ..... G09G 3/32
(Continued)

FOREIGN PATENT DOCUMENTS

CN 102222465 A 10/2011
CN 107274825 A 10/2017
(Continued)

OTHER PUBLICATIONS

International Search Report dated Jun. 22, 2021, in corresponding International Application No. PCT/CN2021/082569, 4 pages (with English Translation).
(Continued)

*Primary Examiner* — Tom V Sheng
(74) *Attorney, Agent, or Firm* — Maier & Maier, PLLC

(57) ABSTRACT

A pixel circuit, a driving method thereof, and a display device. The pixel circuit includes a data write module, a first reset module, a drive transistor, and a light-emitting module. The data write module is configured to apply a constant first voltage signal inputted from a data signal terminal to a first electrode of the drive transistor at a first reset stage; the first reset module is configured to apply a reset voltage signal inputted from a reset signal terminal to a gate of the drive transistor at the first reset stage; and the data write module is configured to apply a data voltage signal inputted from the data signal terminal to the gate of the drive transistor at a data write stage.

18 Claims, 9 Drawing Sheets

(52) U.S. Cl.
CPC ..... *G09G 2300/0819* (2013.01); *G09G 2300/0842* (2013.01); *G09G 2310/0251* (2013.01); *G09G 2310/0262* (2013.01); *G09G 2310/061* (2013.01); *G09G 2320/0233* (2013.01); *G09G 2320/0257* (2013.01); *G09G 2320/045* (2013.01)

(58) Field of Classification Search
CPC ..... G09G 2300/0819; G09G 2310/061; G09G 2310/0251; G09G 2310/0262; G09G 2320/0257; G09G 2320/0233; G09G 2320/045
USPC ..... 345/204
See application file for complete search history.

(56) References Cited

U.S. PATENT DOCUMENTS

| | | | | |
|---|---|---|---|---|
| 11,538,402 | B2 * | 12/2022 | Yuan | G09G 3/3233 |
| 2007/0268210 | A1 * | 11/2007 | Uchino | G09G 3/3233 345/55 |
| 2008/0129660 | A1 * | 6/2008 | Iida | G09G 3/3233 345/80 |
| 2008/0231559 | A1 * | 9/2008 | Uchino | G09G 3/3233 345/76 |
| 2009/0091562 | A1 * | 4/2009 | Uchino | G09G 3/3233 345/55 |
| 2009/0122047 | A1 * | 5/2009 | Yamamoto | G09G 3/3291 345/55 |
| 2009/0122053 | A1 * | 5/2009 | Yamamoto | G09G 3/3233 345/213 |
| 2009/0160847 | A1 * | 6/2009 | Tanikame | G09G 3/3275 345/84 |
| 2012/0169798 | A1 * | 7/2012 | Ebisuno | G09G 3/325 345/77 |
| 2014/0176006 | A1 * | 6/2014 | Kawabe | G09G 3/2092 315/291 |
| 2016/0253958 | A1 * | 9/2016 | Ma | G09G 3/3233 345/211 |
| 2017/0116918 | A1 * | 4/2017 | Dong | G09G 3/20 |
| 2017/0256200 | A1 * | 9/2017 | Duan | G09G 3/3233 |
| 2017/0270860 | A1 * | 9/2017 | Wang | G09G 3/3258 |
| 2019/0057646 | A1 * | 2/2019 | Lin | G09G 3/3225 |
| 2019/0371238 | A1 * | 12/2019 | Gao | G09G 3/3233 |
| 2020/0410926 | A1 * | 12/2020 | Li | G09G 3/3233 |
| 2021/0280130 | A1 * | 9/2021 | Wang | G09G 3/3233 |
| 2022/0223083 | A1 * | 7/2022 | Lai | G09G 3/20 |
| 2022/0223084 | A1 * | 7/2022 | Lai | G09G 3/20 |

FOREIGN PATENT DOCUMENTS

| | | | |
|---|---|---|---|
| CN | 107316613 | A | 11/2017 |
| CN | 107342044 | A | 11/2017 |
| CN | 107358917 | A | 11/2017 |
| CN | 107481676 | A | 12/2017 |
| CN | 108493350 | A | 9/2018 |
| CN | 109036279 | A | 12/2018 |
| CN | 109509433 | A | 3/2019 |
| CN | 109677091 | A | 4/2019 |
| CN | 109872692 | A | 6/2019 |
| CN | 109903724 | A | 6/2019 |
| CN | 110223636 | A | 9/2019 |
| CN | 110246462 | A | 9/2019 |
| CN | 110570813 | A | 12/2019 |
| CN | 110675815 | A | 1/2020 |
| CN | 110942743 | A | 3/2020 |
| CN | 111445858 | A | 7/2020 |
| KR | 10-2012-0043301 | A | 5/2012 |

OTHER PUBLICATIONS

First Office Action dated Jan. 6, 2021, corresponding to Chinese Application No. 202010312773.9; 18 pages, (with machine-generated English Translation).
Notification of Rejection dated Oct. 11, 2021, corresponding to Chinese Application No. 202010312773.9, 12 pages (with machine-generated English Translation).
Second Office Action dated Jul. 30, 2021, corresponding to Chinese Application No. 202010312773.9, 14 pages (with machine-generated English Translation).

* cited by examiner

PIXEL CIRCUIT, DRIVING METHOD THEREOF, AND DISPLAY DEVICE

CROSS REFERENCE TO RELATED APPLICATIONS

This application is a continuation of International Patent Application No. PCT/CN2021/082569, filed Mar. 24, 2021, which is based on and claims priority to Chinese Patent Application No. 202010312773.9 filed with the China National Intellectual Property Administration (CNIPA) on Apr. 20, 2020, the disclosures of which are incorporated herein by reference in their entireties.

TECHNICAL FIELD

Embodiments of the present application relate to the field of display technology, for example, to a pixel circuit, a driving method thereof, and a display device.

BACKGROUND

With the development of display technology, the requirements for display effects are increasing.

The display panel usually includes a plurality of pixel circuits and a plurality of light-emitting elements, and the light-emitting elements are driven by the pixel circuits to emit light for display.

However, there is a problem of instantaneous afterimage in the display panel, which makes the display effect poor.

SUMMARY

The present application provides a pixel circuit, a driving method thereof, and a display device to improve the instantaneous afterimage and improve the display effect.

In a first aspect, an embodiment of the present application provides a pixel circuit. The pixel circuit includes a data write module, a second reset module, a first reset module, a drive transistor, and a light-emitting module. The data write module is configured to apply a constant first voltage signal inputted from a data signal terminal to a first electrode of the drive transistor at a first reset stage; the first reset module is configured to apply a reset voltage signal inputted from a reset signal terminal to a gate of the drive transistor at the first reset stage; and the data write module is configured to apply a data voltage signal inputted from the data signal terminal to the gate of the drive transistor at a data write stage.

In a second aspect, an embodiment of the present application provides a driving method of a pixel circuit which is used for driving the pixel circuit provided in the first aspect. The driving method of a pixel circuit includes the following steps. At a first reset stage, a data signal terminal is provided with a constant first voltage signal, and a data write module is controlled to be turned on, and the data write module applies the constant first voltage signal inputted from the data signal terminal to a first electrode of a drive transistor; and a first reset module is controlled to be turned on, and a reset voltage signal inputted from a reset signal terminal is applied to a gate of the drive transistor. At a data write stage, the data signal terminal is provided with a data voltage signal, the data write module is controlled to be turned on, and the data voltage signal inputted from the data signal terminal is applied to the gate of the drive transistor.

In a third aspect, an embodiment of the present application provides a display device. The display device includes the pixel circuit provided in the first aspect and further includes a driver chip and a plurality of data lines. Each data line is connected with at least one column of pixel circuits, and the driver chip is configured to output a constant first voltage signal to each of the plurality of data lines at a first reset stage and output a data voltage signal to each of the plurality of data lines at a data write stage.

In some embodiments of the present application, at the first reset stage and the data write stage, the data signal terminal is provided with a constant first voltage signal and a data voltage signal, respectively. At the first reset stage, the data write module applies the constant first voltage signal to the first electrode of the drive transistor, and at the first reset stage, the first reset module applies the reset voltage signal inputted from the reset signal terminal to the gate of the drive transistor. In this way, the drive transistor can be reset at the first reset stage, and when grayscale switching is performed in different frames, no matter what grayscale was displayed in the previous frame, at the first reset stage of the current frame, the drive transistor will be restored to the initial state. Therefore, the trapping and releasing of carriers in the active layer, the gate insulating layer, and the interface between the active layer and the gate insulating layer of the drive transistor tend to be consistent during the grayscale switching process. Therefore, when different grayscales are switched to the same grayscale, the drive transistor can generate the same drive current, and the brightness of the light-emitting module is basically the same, thereby reducing the afterimage and improving the display effect.

DETAILED DESCRIPTION

Figure 1:
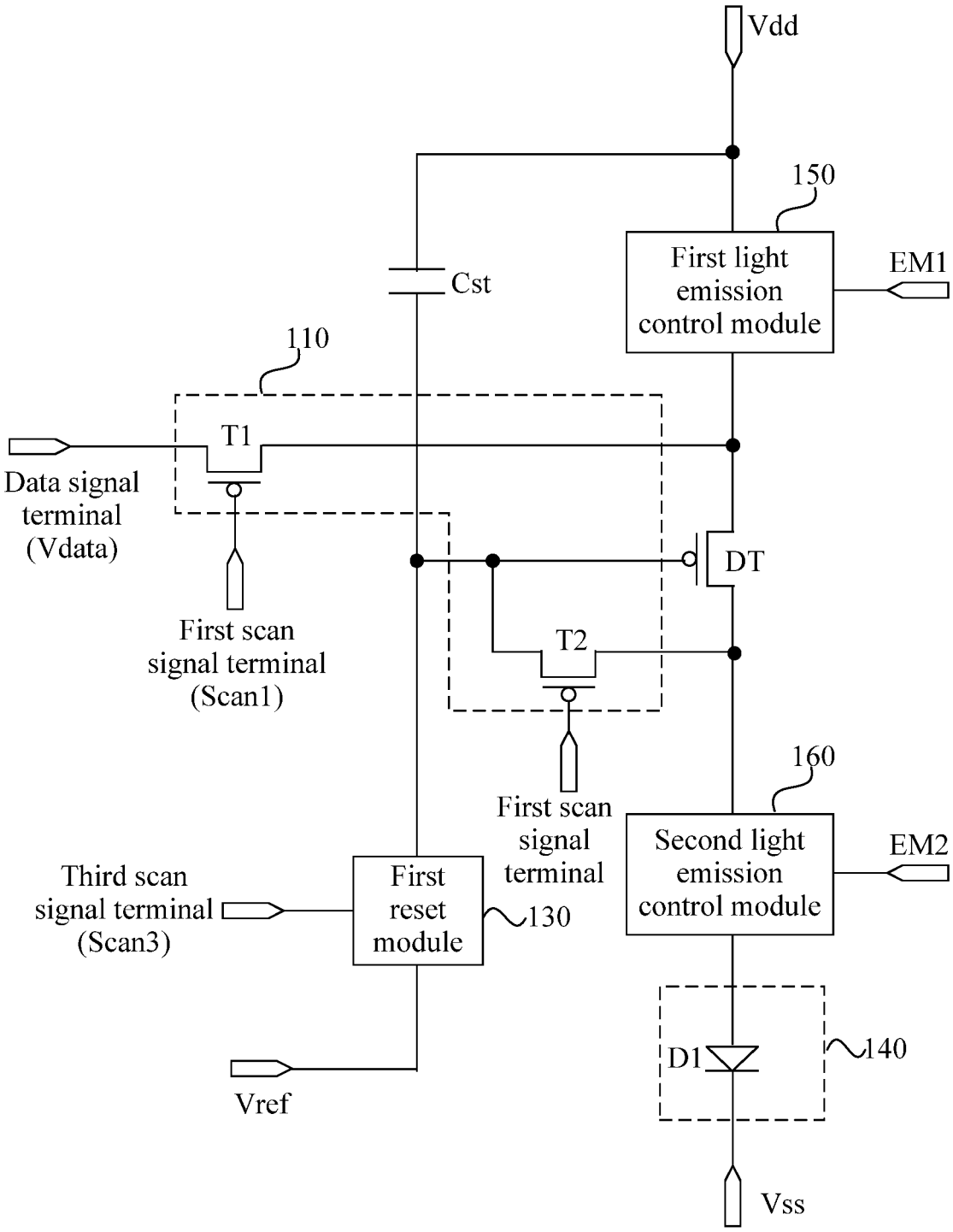
FIG. 1 is a structural view of a pixel circuit according to an embodiment of the present application.

The present application is described below in conjunction with drawings and embodiments. The embodiments described herein are merely intended to explain the present application and not to limit the present application.

As described, there is a problem of instantaneous afterimage in the display panel. For example, when different grayscales displayed in the display panel are switched to the same grayscale, the brightness of the light-emitting element is different, which results in the poor display effect. It is found that the reason for the above problem is as follows.

The display panel usually includes a plurality of pixel circuits, each pixel circuit includes a drive transistor for driving the light-emitting element to emit light, and the drive transistor controls the brightness of the light-emitting element by controlling the drive current flowing through the light-emitting element. The magnitude of the drive current generated by the drive transistor is related to the gate-source voltage of the drive transistor, and the magnitude of the gate-source voltage of the drive transistor is different with different display grayscales. A difference in the gate-source voltage of the drive transistor results in different working states of the drive transistor, which causes different trapping and releasing of carriers in the active layer, the gate insulating layer, and the interface between the active layer and the gate insulating layer of the drive transistor. In this way, when different grayscales are switched to the same grayscale, the magnitude of the drive current of the drive transistor is different with different gate-source voltages of the drive transistor, which eventually leads to the difference in brightness and the formation of afterimage. In the related art, when the gate of the drive transistors is initialized, the source of the drive transistor is usually in a floating state. The change of the gate potential causes the change of the source potential. As a result, the reset of the drive transistor is insufficient and the instantaneous afterimage exists.

Based on the above problem, an embodiment of the present application provides a pixel circuit. The pixel circuit includes a data write module, a first reset module, a drive transistor, and a light-emitting module. The data write module is configured to apply a constant first voltage signal inputted from a data signal terminal to a first electrode of the drive transistor at a first reset stage. The first reset module is configured to apply a reset voltage signal inputted from a reset signal terminal to a gate of the drive transistor at the first reset stage. The data write module is configured to apply a data voltage signal from the data signal terminal to the gate of the drive transistor at a data write stage.

In some embodiments, the first reset stage may be performed before the data write stage in a frame.

At the first reset stage, the data write module applies the constant first voltage signal inputted from the data signal terminal to the first electrode of the drive transistor, and the first reset module applies the reset voltage signal inputted from the reset signal terminal to the gate of the drive transistor, so that the gate and the first electrode of the drive transistor are reset at the first reset stage, which makes the gate-source voltage of the drive transistors in a plurality of pixel circuits equal after the first reset stage, that is, the initial states of the drive transistors in the plurality of pixel circuits are consistent, and the drive transistors are reset. In this way, in a display panel including a plurality of pixel circuits, the drive transistors in the plurality of pixel circuits can be restored to the same state at the first reset stage, and when grayscale switching is performed in different frames, no matter what grayscale was displayed in the previous frame, at the first reset stage of the current frame, the drive transistor will be restored to the initial state. Therefore, the trapping and releasing of carriers in the active layer, the gate insulating layer, and the interface between the active layer and the gate insulating layer of the drive transistor tend to be consistent during the grayscale switching process. Therefore, when different grayscales are switched to the same grayscale, the drive transistor can generate the same drive current, and the brightness of the light-emitting module is basically the same, thereby reducing the afterimage and improving the display effect. Moreover, in the embodiments of the present application, the reset of the first electrode of the drive transistor is achieved through the signal inputted from the data signal terminal, and thus there is no need to set additional module to reset the first electrode of the drive transistor, thereby simplifying the structure of the pixel circuit, reducing the area of the pixel circuit, and improving the pixel density.

In the embodiments of the present application, at the first reset stage and the data write stage, the data signal terminal is provided with a constant first voltage signal and a data voltage signal, respectively. At the first reset stage, the data write module applies the constant first voltage signal to the first electrode of the drive transistor, and at the first reset stage, the first reset module applies the reset voltage signal inputted from the reset signal terminal to the gate of the drive transistor, that is, at the first reset stage, the first voltage signal inputted from the data signal terminal serves as the reset signal of the first electrode of the drive transistor, and the reset voltage signal inputted from the reset signal terminal serves as the reset signal of the gate of the drive transistor. Accordingly, with the data write module and the first reset module controlled to be turned on in the pixel circuit at the first reset stage, the first voltage signal can be transmitted to the first electrode of the drive transistor, and the reset voltage signal can be transmitted to the gate of the drive transistor, and thus the drive transistor is reset at the first reset stage. In this way, when grayscale switching is performed in different frames, no matter what grayscale was displayed in the previous frame, at the first reset stage of the current frame, the drive transistor will be restored to the initial state, and then the trapping and releasing of carriers in the active layer, the gate insulating layer, and the interface between the active layer and the gate insulating layer of the drive transistor tend to be consistent during the grayscale switching process. Therefore, when different grayscales are switched to the same grayscale, the drive transistor can generate the same drive current, and the brightness of the light-emitting module is basically the same, thereby reducing the afterimage and improving the display effect.

In some embodiments, the pixel circuit further includes a second reset module. The second reset module is configured to apply the reset voltage signal from the reset signal terminal to a second electrode of the drive transistor at the first reset stage.

At a first reset stage, the second reset module applies the reset signal inputted from the reset signal terminal to the second electrode of the drive transistor so that the second electrode of the drive transistor can also be reset, that is, at the first reset stage, the first electrode, the second electrode, and the gate of the drive transistor can all be reset. In some embodiments, the first electrode serves as the source of the drive transistor, and the second electrode serves as the drain of the drive transistor. In some embodiments, the absolute value of the difference between the reset voltage signal inputted from the reset signal terminal and the first voltage signal inputted from the drive data signal terminal is greater than the absolute value of the threshold voltage of the drive transistor to guarantee that the drive transistor can be turned on at the first reset stage. In this way, a current path is formed between the data signal terminal and the reset signal terminal, thereby achieving the on-state current-mode reset of the drive transistor.

Solutions in embodiments of the present disclosure are described hereinafter in conjunction with drawings in embodiments of the present application.

FIG. 1 is a structural view of a pixel circuit according to an embodiment of the present application. With reference to FIG. 1, the pixel circuit includes a data write module 110, a first reset module 130, a drive transistor DT, and a light-emitting module 140. The data write module 110 includes a write transistor T1 and a compensation transistor T2. The write transistor T1 is configured to control a connection state between the data signal terminal Vdata and the first electrode of the drive transistor DT according to a signal of a first scan signal terminal Scan1. A gate of the write transistor T1 is electrically connected with the first scan signal terminal Scan1, a first electrode of the write transistor T1 is electrically connected with the data signal terminal Vdata, and a second electrode of the write transistor T1 is electrically connected with the first electrode of the drive transistor DT. The compensation transistor T2 is configured to control a connection state between the second electrode of the drive transistor DT and the gate of the drive transistor DT according to the signal of the first scan signal terminal Scan1. A gate of the compensation transistor T2 is electrically connected with the first scan signal terminal Scan1, a first electrode of the compensation transistor T2 is electrically connected with the second electrode of the drive transistor DT, and a second electrode of the compensation transistor T2 is electrically connected with the gate of the drive transistor DT. A control terminal of the first reset module 130 is electrically connected with a third scan signal terminal Scan3, a first terminal of the first reset module 130 is electrically connected with the reset signal terminal Vref, and a second terminal of the first reset module 130 is electrically connected with the gate of the drive transistor DT.

Figure 2:
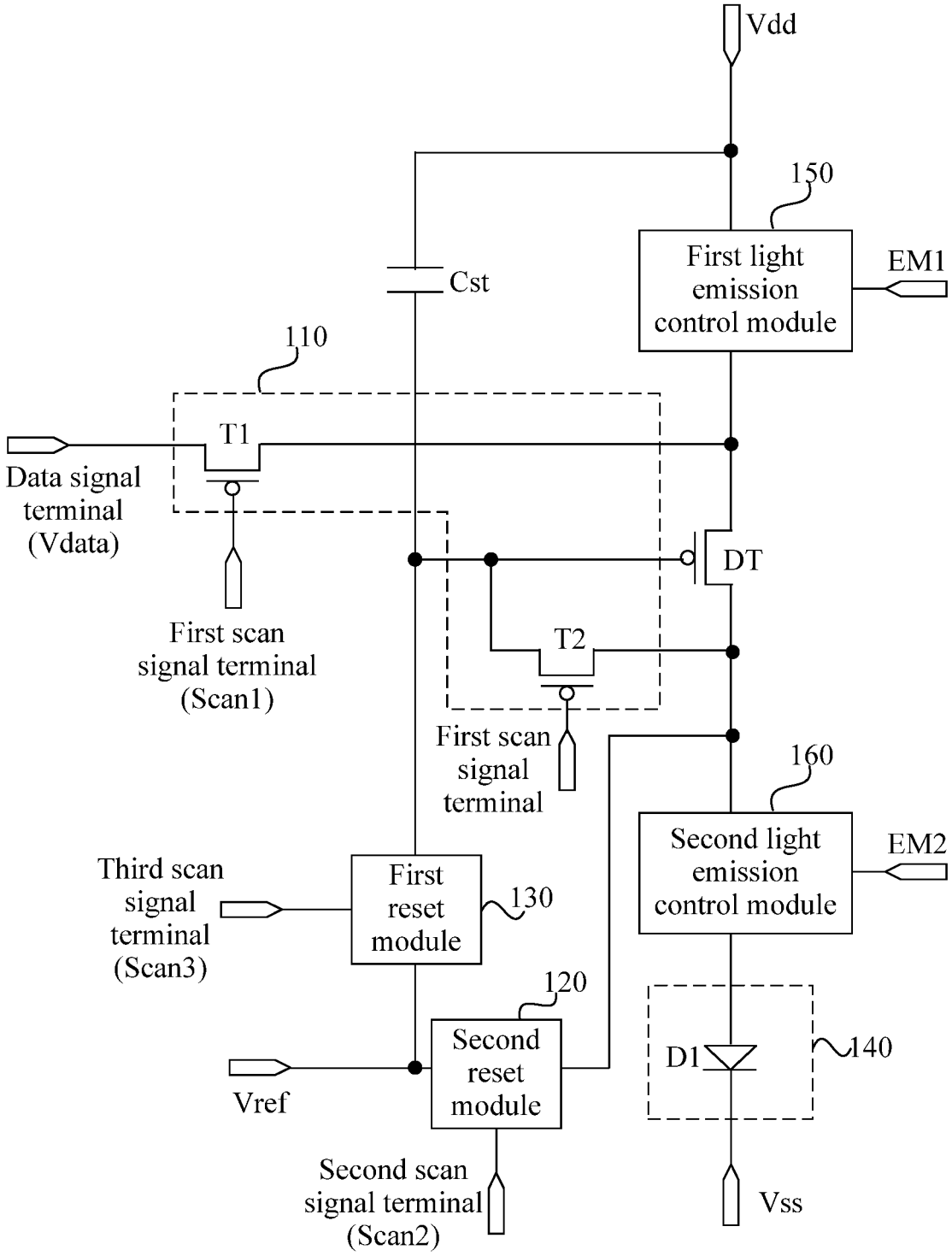
FIG. 2 is a structural view of another pixel circuit according to another embodiment of the present application.

FIG. 2 is a structural view of another pixel circuit according to another embodiment of the present application. In some embodiments, with reference to FIG. 2, on the basis of the pixel circuit shown in FIG. 1, the pixel circuit further includes a second reset module 120. A control terminal of the second reset module 120 is electrically connected with a second scan signal terminal Scan2, a first terminal of the second reset module 120 is electrically connected with the reset signal terminal Vref, and a second terminal of the second reset module 120 is electrically connected with the second electrode of the drive transistor DT.

With continued reference to FIGS. 1 and 2, the pixel circuit further includes a first light emission control module 150, a second light emission control module 160, and a storage module. The first light emission control module 150 is configured to control a connection state between a first supply voltage terminal Vdd and the first electrode of the drive transistor DT according to a signal of a first light emission control signal terminal EM1. The second light emission control module 160 is configured to control a connection state between the second electrode of the drive transistor DT and a first terminal of the light-emitting module 140 according to a signal of a second light emission control signal terminal EM2. A second terminal of the light-emitting module 140 is electrically connected with a second supply voltage terminal Vss. The first light emission control module 150 is further configured to be turned off under the control of the first light emission control signal terminal EM1 at the first reset stage and the data write stage, and the second light emission control module 160 is further configured to be turned off under the control of the second light emission control signal terminal EM2 at the first reset stage and the data write stage. The storage module is configured to store a gate voltage of the drive transistor DT.

With reference to FIGS. 1 and 2, in some embodiments, a control terminal of the first light emission control module 150 is electrically connected with the first light emission control signal terminal EM1, a first terminal of the first light emission control module 150 is electrically connected with the first supply voltage terminal Vdd, and a second terminal of the first light emission control module 150 is electrically connected with the first electrode of the drive transistor DT. A control terminal of the second light emission control module 160 is electrically connected with the second light emission control signal terminal EM2, a first terminal of the second light emission control module 160 is electrically connected with the second electrode of the drive transistor DT, a second terminal of the second light emission control module 160 is electrically connected with the first terminal of the light-emitting module 140, and the second terminal of the light-emitting module 140 is electrically connected with the second supply voltage terminal Vss.

Figure 3:
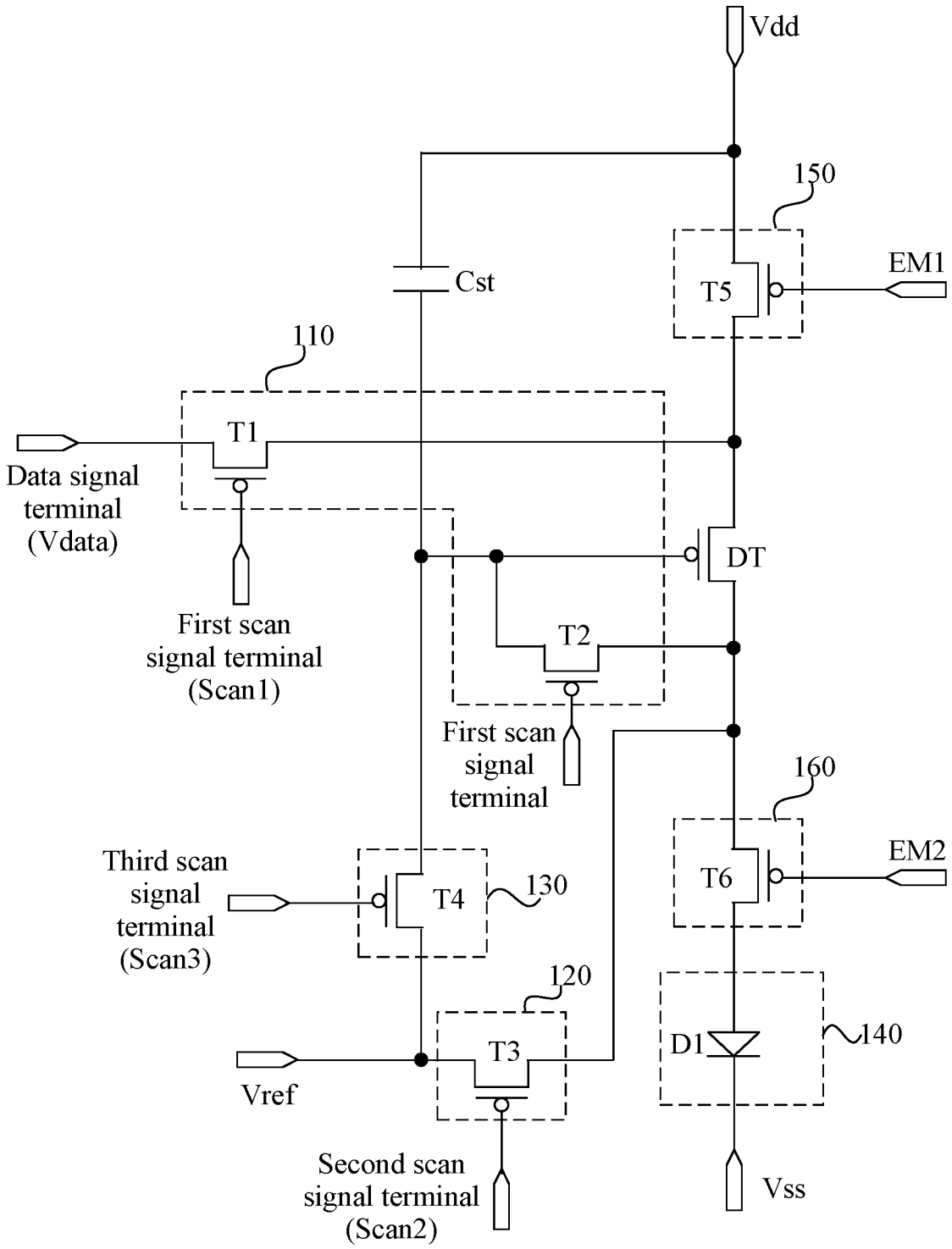
FIG. 3 is a structural view of another pixel circuit according to another embodiment of the present application.

FIG. 3 is a structural view of another pixel circuit according to another embodiment of the present application. The pixel circuit may correspond to the exemplary circuit of the pixel circuit shown in FIG. 2. The second reset module 120 includes a first reset transistor T3. The first reset module 130 may include a second reset transistor T4. The first light emission control module 150 may include a first light emission control transistor T5. The second light emission control module 160 may include a second light emission control transistor T6. The light-emitting module 140 may include an organic light-emitting element D1. The storage module includes a storage capacitor Cst. One terminal of the storage capacitor Cst is electrically connected with the first supply voltage terminal Vdd, and the other terminal of the storage capacitor Cst is electrically connected with the gate of the drive transistor DT.

Figure 4:
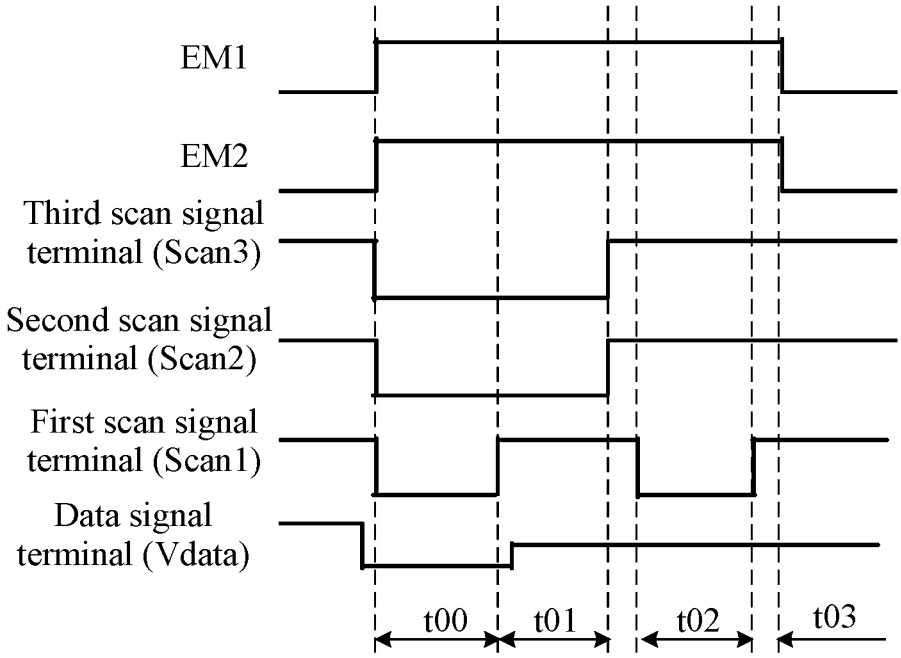
FIG. 4 is a drive timing diagram of a pixel circuit according to an embodiment of the present application.

FIG. 4 is a drive timing diagram of a pixel circuit according to an embodiment of the present application. The driving timing may be applied to the pixel circuits shown in FIGS. 2 and 3 and is illustrated by using an example of the working of the pixel circuit shown in FIG. 3. The plurality of transistors included in the pixel circuit provided in this embodiment may be P-type transistors or N-type transistors, and both of this embodiment and the following embodiments will be described by using an example in which all the transistors included in the pixel circuit are P-type transistors (the turn-on control signal for the P-type transistor is a low-level signal).

With reference to FIGS. 3 and 4, the working process of the pixel circuit includes a first reset stage t00, a second reset stage t01, a data write stage t02, and a light emission stage t03.

At the first reset stage t00, a low-level signal is inputted from the first scan signal terminal Scan1, and the write transistor T1 and the compensation transistor T2 are turned on. A constant first voltage signal is inputted from the data signal terminal Vdata, and the first voltage signal is applied to the first electrode of the drive transistor DT through the turned-on write transistor T1. At the first reset stage t00, a low-level signal is inputted from the second scan signal terminal Scan2, the second reset module 120 (the first reset transistor T3) is turned on, and a reset voltage signal inputted from the reset signal terminal Vref is applied to the second electrode of the drive transistor DT through the turned-on first reset transistor T3. At the first reset stage t00, a low-level signal is inputted from the third scan signal terminal Scan3, the first reset module 130 (the second reset transistor T4) is turned on, and the reset voltage signal inputted from the reset signal terminal Vref is applied to the gate of the drive transistor DT through the turned-on second reset transistor T4. In this way, the forced full reset of the drive transistor DT is achieved at the first reset stage t00, thereby facilitating the improvement of the instantaneous afterimage.

At the second reset stage t01, a low-level signal is inputted from the second scan signal terminal Scan2, the second reset module 120 (the first reset transistor T3) is turned on, and the reset voltage signal inputted from the reset signal terminal Vref is applied to the second electrode of the drive transistor DT through the turned-on first reset transistor T3. At the second reset stage t01, a low level is inputted from the third scan signal terminal Scan3, the first reset module 130 (the second reset transistor T4) is turned on, and the reset voltage signal inputted from the reset signal terminal Vref is applied to the gate of the drive transistor DT through the turned-on second reset transistor T4. It is to be noted that since the gate of the drive transistor DT can be reset at the first reset stage t00, the second reset stage t01 may be omitted.

At the data write stage t02, a low-level signal is inputted from the first scan signal terminal Scan1, the write transistor T1 and the compensation transistor T2 are turned on, a data voltage signal is inputted from the data signal terminal Vdata, and the data voltage signal is written to the gate of the drive transistor DT through the turned-on write transistor T1, drive transistor DT, and compensation transistor T2, thereby achieving the compensation for the data voltage signal and the threshold voltage of the drive transistor DT.

At the first reset stage t00, the second reset stage t01, and the data write stage t02, high-level signals are inputted from the first light emission control signal terminal EM1 and the second light emission control signal terminal EM2, and the first light emission control module 150 (the fifth transistor T5) and the second light emission control module 160 (the sixth transistor T6) are turned off.

At the light emission stage t03, low-level signals are inputted from the first light emission control signal terminal EM1 and the second light emission control signal terminal EM2, the first light emission control module 150 (the fifth transistor T5) and the second light emission control module 160 (the sixth transistor T6) are turned on, and the drive transistor DT drives the light-emitting module 140 to emit light.

In the driving timing shown in FIG. 4, since the signals inputted from the first light emission control signal terminal EM1 and the second light emission control signal terminal EM2 are the same, the first light emission control signal terminal EM1 and the second light emission control signal terminal EM2 may be the same light emission control signal terminal, which means that the control terminals of the first light emission control module 150 and the second light emission control module 160 may be connected with the same port, which also means that the control terminals of the first light emission control module 150 and the second light emission control module 160 may be connected with the same light emission control signal line, thereby saving the number of light emission control signal lines in the display panel which includes the pixel circuit of this embodiment and facilitating the simplification of wiring.

The driving timing of the pixel circuit shown in FIG. 1 is obtained by deleting the timing of the second scan signal terminal Scan2 in the driving timing shown in FIG. 4 while remaining other timing unchanged. The pixel circuit shown in FIG. 1 does not include the second reset module, but the working process of the other modules is the same as the working process of the modules in the pixel circuit shown in FIG. 3. The drive transistors DT in the plurality of pixel circuits are restored to the same initial state at the first reset stage by resetting the gate and the first electrode of the drive transistor DT at the first reset stage, thereby improving the afterimage.

Figure 5:
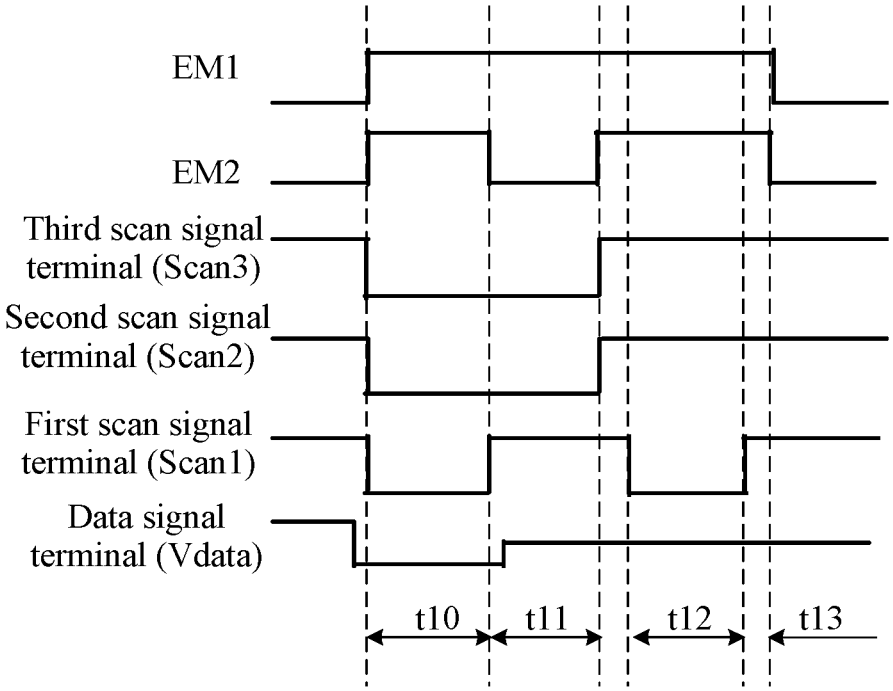
FIG. 5 is a drive timing diagram of another pixel circuit according to another embodiment of the present application.

FIG. 5 is a drive timing diagram of another pixel circuit according to another embodiment of the present application. The driving timing may be applied to driving the pixel circuits shown in FIGS. 2 and 3. With reference to FIGS. 2, 3, and 5, the second reset module 120 is further configured to be turned on under the control of an input signal of the second scan signal terminal Scan2 at the second reset stage t11, and the second light emission control module 160 is further configured to be turned on under the control of an input signal of the second light emission control signal terminal EM2 at the second reset stage t11 so that the reset voltage signal inputted from the reset signal terminal Vref is applied to the first terminal of the light-emitting module 140 through the second reset module 120 and the second light emission control module 160.

Within one frame, the second reset stage t11 is between the first reset stage t10 and the data write stage t12.

With reference to FIGS. 2, 3, and 5, the working process of the pixel circuit includes a first reset stage t10, a second reset stage t11, a data write stage t12, and a light emission stage t13.

The working process of the pixel circuit at the first reset stage t10 is the same as the working process of the driving timing shown in FIG. 4 at the first reset stage t00, and thus will not be repeated here. The forced full reset of the drive transistor DT is achieved at the first reset stage t10, thereby facilitating the improvement of the instantaneous afterimage.

At the second reset stage t11, a low-level signal is inputted from the second scan signal terminal Scan2, the second reset module 120 (the first reset transistor T3) is turned on. Moreover, at the second reset stage t11, a low-level signal is inputted from the second light emission control signal terminal EM2, and a reset voltage signal inputted from the reset signal terminal Vref is applied to the first terminal of the light-emitting module 140 (the anode of the organic light-emitting element D1) through the turned-on first reset transistor T3 and second light emission control module 160, thereby avoiding the influence of residual charge at the first terminal of the light-emitting module 140 on the display effect. At the second reset stage t11, a low-level signal is inputted from the third scan signal terminal Scan3, the first reset module 130 (the second reset transistor T4) is turned on, and the reset voltage signal inputted from the reset signal terminal Vref is applied to the gate of the drive transistor DT through the turned-on second reset transistor T4.

At the data write stage t12, a low-level signal is inputted from the first scan signal terminal Scan1, the write transistor T1 and the compensation transistor T2 are turned on, a data voltage signal is inputted from the data signal terminal Vdata, and the data voltage signal is applied to the gate of the drive transistor DT through the turned-on write transistor T1, drive transistor DT, and compensation transistor T2, thereby achieving the compensation for the data voltage signal and the threshold voltage of the drive transistor DT.

At the first reset stage t10, the second reset stage t11, and the data write stage t12, a high-level signal is inputted from the first light emission control signal terminal EM1, and the first light emission control transistor T5 is turned off. At the light emission stage t13, a low-level signal is inputted from the first light emission control signal terminal EM1, the first light emission control module 150 (the first light emission control transistor T5) is turned on, a low-level signal is inputted from the second light emission control signal terminal EM2, the second light emission control module 160 (the second light emission control transistor T6) is turned on, and the drive transistor DT drives the light-emitting module 140 to emit light.

The driving timing shown in FIG. 5 differs from the driving timing shown in FIG. 4 in that the timing of the first light emission control signal terminal EM1 and the second light emission control signal terminal EM2 are different, and accordingly, the first light emission control signal terminal EM1 and the second light emission control signal terminal EM2 of the pixel circuit are different light emission control signal terminals, that is, the control terminal of the first light emission control module 150 and the control terminal of the second light emission control module 160 are connected with different ports. The first light emission control signal terminal EM1 and the second light emission control signal terminal EM2 are set as different light emission control signal terminals so that the first light emission control module 150 and the second light emission control module 160 are controlled by different light emission control signals, which can achieve the reset of the first terminal of the light-emitting module 140 through the second reset module 120 and the second light emission control module 160, thereby avoiding the influence of residual charge at the first terminal of the light-emitting module 140 on the display effect.

Figure 6:
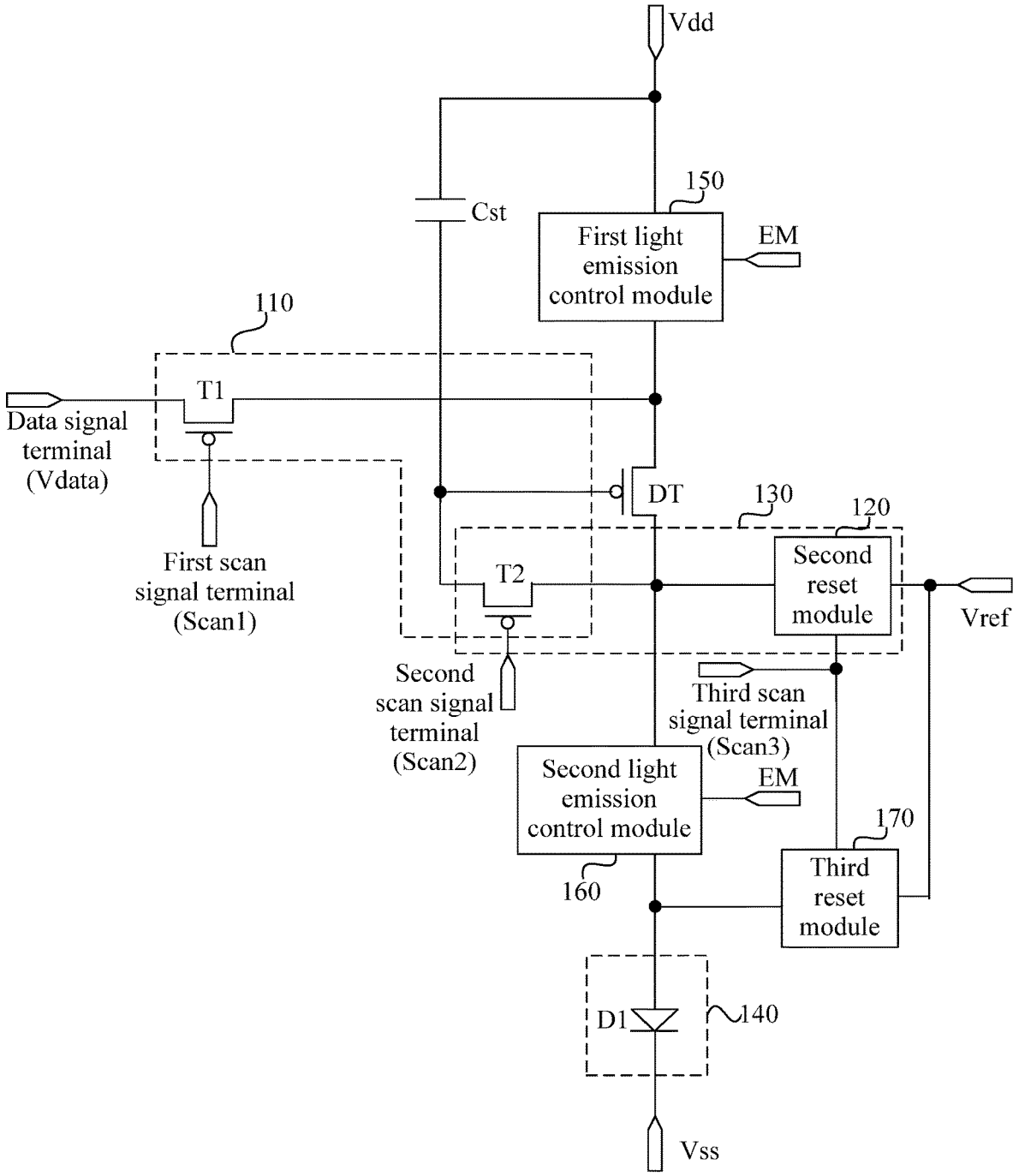
FIG. 6 is a structural view of another pixel circuit according to another embodiment of the present application.

FIG. 6 is a structural view of another pixel circuit according to another embodiment of the present application. With reference to FIG. 6, the pixel circuit includes a data write module 110, a second reset module 120, a first reset module 130, a drive transistor DT, and a light-emitting module 140. The data write module 110 includes a write transistor T1 and a compensation transistor T2. The write transistor T1 is configured to control a connection state between the data signal terminal Vdata and the first electrode of the drive transistor DT according to a signal of the first scan signal terminal Scan1. The gate of the write transistor T1 is electrically connected with the first scan signal terminal Scan1, the first electrode of the write transistor T1 is electrically connected with the data signal terminal Vdata, and the second electrode of the write transistor T1 is electrically connected with the first electrode of the drive transistor DT. The compensation transistor T2 is configured to control a connection state between the second electrode of the drive transistor DT and the gate of the drive transistor DT according to the signal of the first scan signal terminal Scan1. The gate of the compensation transistor T2 is electrically connected with the second scan signal terminal Scan2, the first electrode of the compensation transistor T2 is electrically connected with the second electrode of the drive transistor DT, and the second electrode of the compensation transistor T2 is electrically connected with the gate of the drive transistor DT. The control terminal of the second reset module 120 is electrically connected with the third scan signal terminal Scan3, the first terminal of the second reset module 120 is electrically connected with the reset signal terminal Vref, and the second terminal of the second reset module 120 is electrically connected with the second electrode of the drive transistor DT. The second reset module 120 and the compensation transistor T2 form the first rest module 130.

With continued reference to FIG. 6, the pixel circuit further includes a first light emission control module 150, a second light emission control module 160, and a third reset module 170. The first light emission control module 150 is configured to control a connection state between the first supply voltage terminal Vdd and the first electrode of the drive transistor DT according to a signal of a light emission control signal terminal.

The second light emission control module 160 is configured to control a connection state between the second electrode of the drive transistor DT and the first terminal of the light-emitting module 140 according to the signal of the light emission control signal terminal. The second terminal of the light-emitting module 140 is electrically connected with the second supply voltage terminal vss.

The control terminal of the first light emission control module 150 is electrically connected with the light emission control signal terminal EM, the first terminal of the first light emission control module 150 is electrically connected with the first supply voltage terminal Vdd, and the second terminal of the first light emission control module 150 is electrically connected with the first electrode of the drive transistor DT. The control terminal of the second light emission control module 160 is electrically connected with the light emission control signal terminal EM, the first electrode of the second light emission control module 160 is electrically connected with the second electrode of the drive transistor DT, the second terminal of the second light emission control module 160 is electrically connected with the first terminal of the light-emitting module 140, and the second terminal of the light-emitting module 140 is electrically connected with the second supply voltage terminal Vss. The third reset module 170 is configured to control a connection state between the reset signal terminal Vref and the first terminal of the light-emitting module according to a signal of the third scan signal terminal Scan3. The control terminal of the third reset module 170 is electrically connected with the third scan signal terminal Scan3, the first terminal of the third reset module 170 is electrically connected with the reset signal terminal Vref, the second terminal of the third reset module 170 is electrically connected with the first terminal of the light-emitting module 140, and the second terminal of the light-emitting module 140 is electrically connected with the second supply voltage terminal Vss. The third reset module 170 is further configured to be turned on under the control of an input signal of the third scan signal terminal Scan3 at the first reset stage to reset the first terminal of the light-emitting module 140.

The light emission control module includes a first light emission control module 150 and a second light emission control module 160, and the control terminals of the first light emission control module 150 and the second light emission control module 160 are connected with the same light emission control signal terminal EM.

Figure 7:
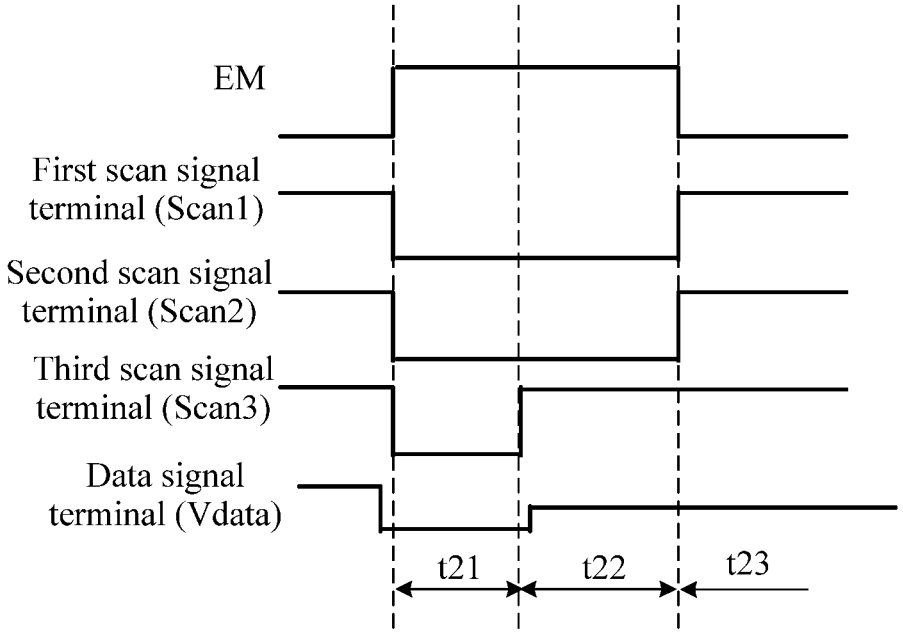
FIG. 7 is a drive timing diagram of another pixel circuit according to another embodiment of the present application.

FIG. 7 is a drive timing diagram of another pixel circuit according to another embodiment of the present application. The driving timing may be applied to the pixel circuits shown in FIG. 6 and the working process is illustrated by using an example in which transistors included in the second reset module 120, the first light emission control module 150, the second light emission control module 160, the third reset module 170, and other modules of the pixel circuit shown in FIG. 6 are all P-type transistors. With reference to FIGS. 6 and 7, the working process of the pixel circuit shown in FIG. 6 includes a first reset stage t21 a data write stage t22, and a light emission stage t23.

At the first reset stage t21, a low-level signal is inputted from the first scan signal terminal Scan1, the write transistor T1 is turned on, a constant first voltage signal is inputted from the data signal terminal Vdata, and the first voltage signal is applied to the first electrode of the drive transistor DT through the turned-on write transistor T1. At the first reset stage t21, a low-level signal is inputted from the third scan signal terminal Scan3, the second reset module 120 is turned on, and a reset voltage signal inputted from the reset signal terminal Vref is applied to the second electrode of the drive transistor DT through the turned-on second reset module 120. At the first reset stage t21, a low-level signal is inputted from the second scan signal terminal Scan2, the compensation transistor T2 is turned on, the first reset module 130 including the second reset module 120 and the compensation transistor T2 is turned on, and the reset voltage signal inputted from the reset signal terminal Vref is applied to the gate of the drive transistor DT through the turned-on first reset module 130. In this way, the forced full reset of the drive transistor DT is achieved at the first reset stage t21, thereby facilitating the improvement of the instantaneous afterimage. At the first reset stage t21, the third reset module 170 is turned on according to the low-level signal inputted from the third scan signal terminal Scan3, and the reset voltage signal inputted from the reset signal terminal Vref is transmitted to the first terminal of the light-emitting module 140 through the turned-on third reset module 170, which achieves the reset of the first terminal of the light-emitting module 140, thereby eliminating the charge residue at the first terminal of the light-emitting module 140 and facilitating the improvement of the display effect.

At the data write stage t22, low-level signals are inputted from the first scan signal terminal Scan1 and the second scan signal terminal Scan2, the write transistor T1 and the compensation transistor T2 are turned on, a data voltage signal is inputted from the data signal terminal Vdata, and the data voltage signal is applied to the gate of the drive transistor DT through the turned-on write transistor T1, drive transistor DT, and compensation transistor T2, thereby achieving the compensation for the data voltage signal and the threshold voltage of the drive transistor DT.

At the first reset stage t21 and the data write stage t22, a high-level signal is inputted from the light emission control signal terminal EM, and the first light emission control module 150 and the second light emission control module 160 are turned off. At the light emission stage t23, a low-level signal is inputted from the light emission control signal terminal EM, the first light emission control module 150 and the second light emission control module 160 are turned on, and the drive transistor DT drives the light-emitting module 140 to emit light.

Figure 8:
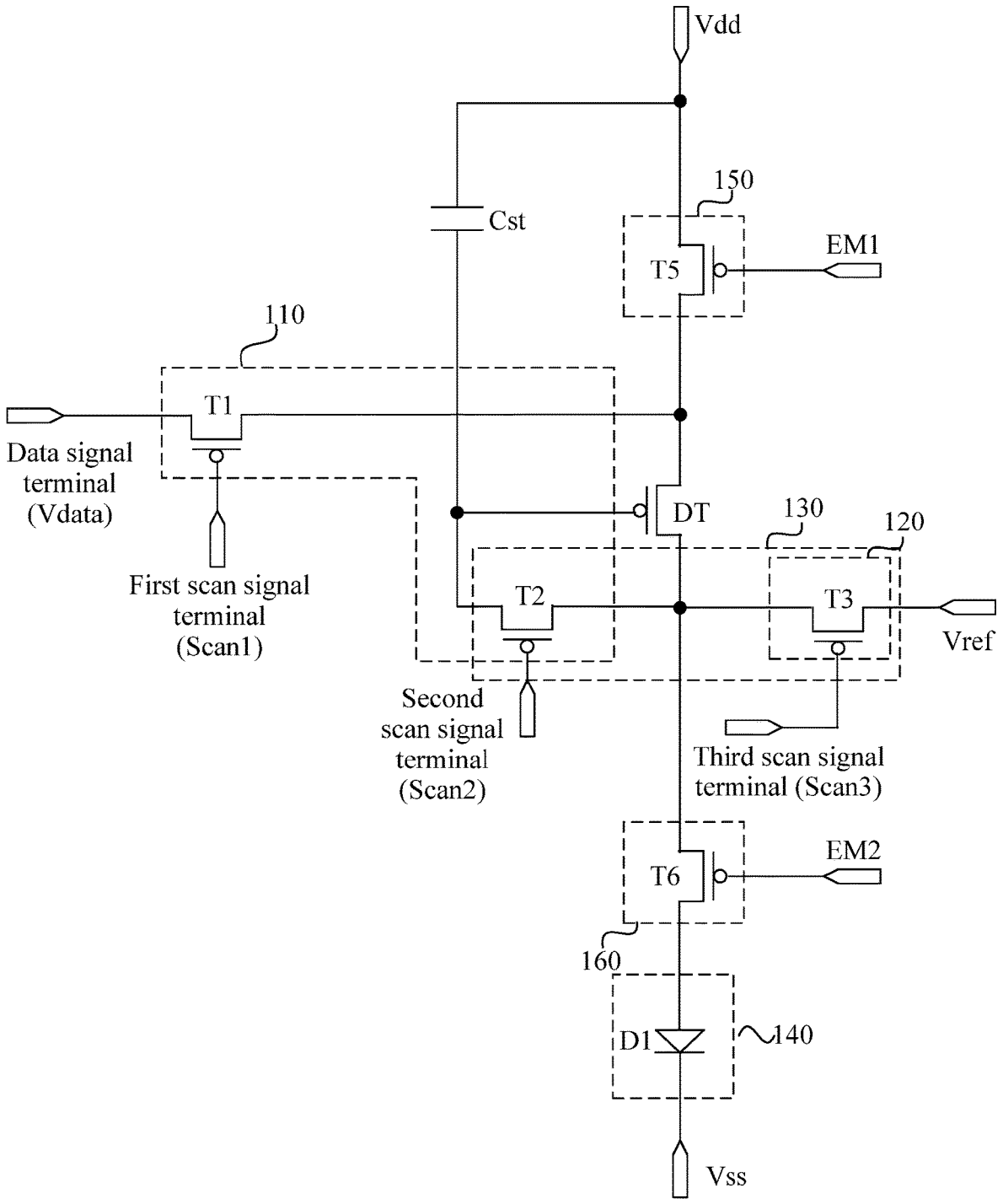
FIG. 8 is a structural view of another pixel circuit according to another embodiment of the present application.

FIG. 8 is a structural view of another pixel circuit according to another embodiment of the present application. With reference to FIG. 8, the pixel circuit differs from the pixel circuit shown in FIG. 6 in that the control terminal of the first light emission control module 150 is connected with the first light emission control signal terminal EM1, the control terminal of the second light emission control module 160 is connected with the second light emission control signal terminal EM2, and the first light emission control signal terminal EM1 and the second light emission control signal terminal EM2 are different light emission control signal terminals. Moreover, the pixel circuit shown in FIG. 8 does not include the third reset module.

With reference to FIG. 8, the first light emission control module 150 is configured to control a connection state between the first supply voltage terminal Vdd and the first electrode of the drive transistor DT according to the signal of the first light emission control signal terminal EM1. The second light emission control module 160 is configured to control a connection state between the second electrode of the drive transistor DT and the first terminal of the light-emitting module 140 according to the signal of the second light emission control signal terminal EM2.

The control terminal of the first light emission control module 150 is electrically connected with the first light emission control signal terminal EM1, the first terminal of the first light emission control module 150 is electrically connected with the first supply voltage terminal Vdd, and the second terminal of the first light emission control module 150 is electrically connected with the first electrode of the drive transistor DT. The control terminal of the second light emission control module 160 is electrically connected with the second light emission control signal terminal EM2, the first terminal of the second light emission control module 160 is electrically connected with the second electrode of the drive transistor DT, the second terminal of the second light emission control module 160 is electrically connected with the first terminal of the light-emitting module 140, and the second terminal of the light-emitting module 140 is electrically connected with the second supply voltage terminal Vss.

The second reset module 120 is further configured to be turned on under the control of an input signal of the third scan signal terminal Scan3 at the second reset stage, and the second light emission control module 160 is further configured to be turned on under the control of an input signal of the second light emission control signal terminal EM2 at the second reset stage so that the reset voltage signal inputted from the reset signal terminal Vref is applied to the first terminal of the light-emitting module 140 through the second reset module 120 and the second light emission control module 160. The first light emission control module 150 is further configured to be turned off under the control of an input signal of the first light emission control signal terminal EM1 at the second reset stage.

Figure 9:
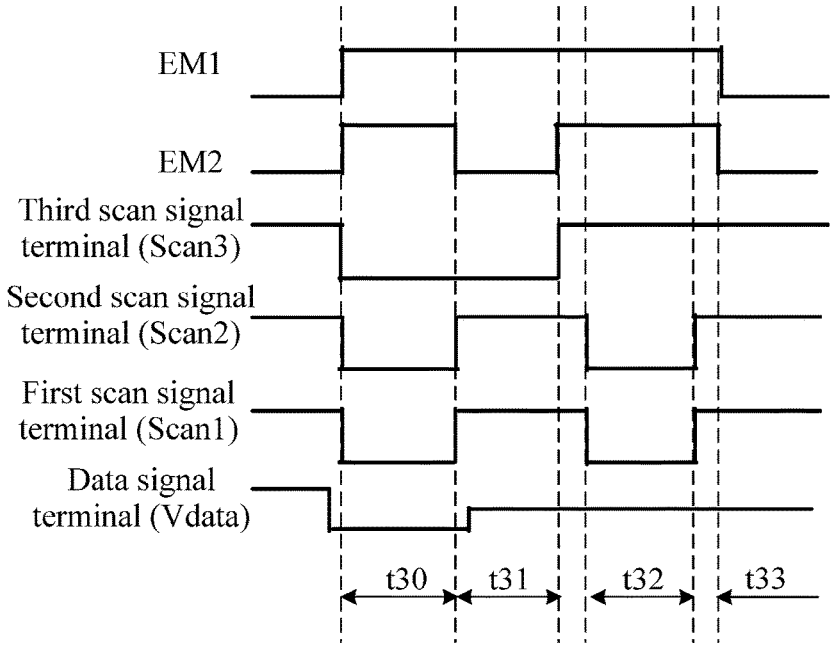
FIG. 9 is a drive timing diagram of another pixel circuit according to another embodiment of the present application.

FIG. 9 is a drive timing diagram of another pixel circuit according to another embodiment of the present application. The driving timing may be applied to driving the pixel circuit shown in FIG. 8. With reference to FIGS. 8 and 9, the working process of the pixel circuit includes a first reset stage t30, a second reset stage t31, a data write stage t32, and a light emission stage t33.

At the first reset stage t30, a low-level signal is inputted from the first scan signal terminal Scan1, the write transistor T1 is turned on, a constant first voltage signal is inputted from the data signal terminal Vdata, and the first voltage signal is applied to the first electrode of the drive transistor DT through the turned-on write transistor T1. At the first reset stage t30, a low-level signal is inputted from the third scan signal terminal Scan3, the second reset module 120 (the first reset transistor T3) is turned on, and a reset voltage signal inputted from the reset signal terminal Vref is applied to the second electrode of the drive transistor DT through the turned-on first reset transistor T3. At the first reset stage t30, a low-level signal is inputted from the second scan signal terminal Scan2, the compensation transistor T2 is turned on, the first reset module 130 formed by the second reset module 120 and the compensation transistor T2 is turned on, and the reset voltage signal inputted from the reset signal terminal Vref is applied to the gate of the drive transistor DT through the turned-on first reset module 130. In this way, the forced full reset of the drive transistor DT is achieved at the first reset stage t30, thereby facilitating the improvement of the instantaneous afterimage.

At the second reset stage t31, a low-level signal is inputted from the third scan signal terminal Scan3, the second reset module 120 (the first reset transistor T3) is turned on, a low-level signal is inputted from the second light emission control signal terminal EM2, the second light emission control module 160 is turned on, and the reset voltage signal inputted from the reset signal terminal Vref is applied to the first terminal of the light-emitting module 140 through the first reset transistor T3 and the second light emission control module 160. That is, at the driving timing shown in FIG. 9, the pixel circuit in this embodiment can achieve the reset of the first terminal of the light-emitting module 140 through the second reset module 120 and the second light emission control module 160, and thus there is no need to set the third reset module shown in FIG. 6, thereby reducing the number of modules included in the pixel circuit. Moreover, since the third reset module usually includes a thin-film transistor, the number of thin-film transistors in the pixel circuit can be reduced, thereby facilitating the reduction of the area of the pixel circuit and improving the pixel density.

At the data write stage t32, low-level signals are inputted from the first scan signal terminal Scan1 and the second scan signal terminal Scan2, the write transistor T1 and the compensation transistor T2 are turned on, a data voltage signal is inputted from the data signal terminal Vdata, and the data voltage signal is applied to the gate of the drive transistor DT through the turned-on write transistor T1, drive transistor DT, and compensation transistor T2, thereby achieving the compensation for the data voltage signal and the threshold voltage of the drive transistor DT.

At the first reset stage t30, the second reset stage t31, and the data write stage t32, a high-level signal is inputted from the first light emission control signal terminal EM1, and the first light emission control module 150 is turned off. At the light emission stage t33, a low-level signal is inputted from the first light emission control signal terminal EM1, the first light emission control module 150 is turned on, a low-level signal is inputted from the second light emission control signal terminal EM2, the second light emission control module 160 is turned on, and the drive transistor DT drives the light-emitting module 140 to emit light.

In the pixel circuit provided by this embodiment, with the relatively small number of the thin-film transistors, the full reset of the drive transistor and the reset of the first terminal of the light-emitting module can be achieved, thereby improving the afterimage, reducing the area of the pixel circuit, and facilitating the improvement of the pixel density.

In any of the above embodiments of the present application, when any two scan signal terminals among the first scan signal terminal, the second scan signal terminal, and the third scan signal terminal in the pixel circuit have the same timing within one frame (for example, the second scan signal terminal and the third scan signal terminal in the pixel circuit shown in FIGS. 2 and 3 have the same timing), the two scan signal terminals may be connected with the same scan line in the display panel, thereby reducing the number of wires.

In any of the above embodiments of the present application, the reset voltage signal inputted from the reset signal terminal is constant and thus not shown in the timing diagram.

Figure 10:
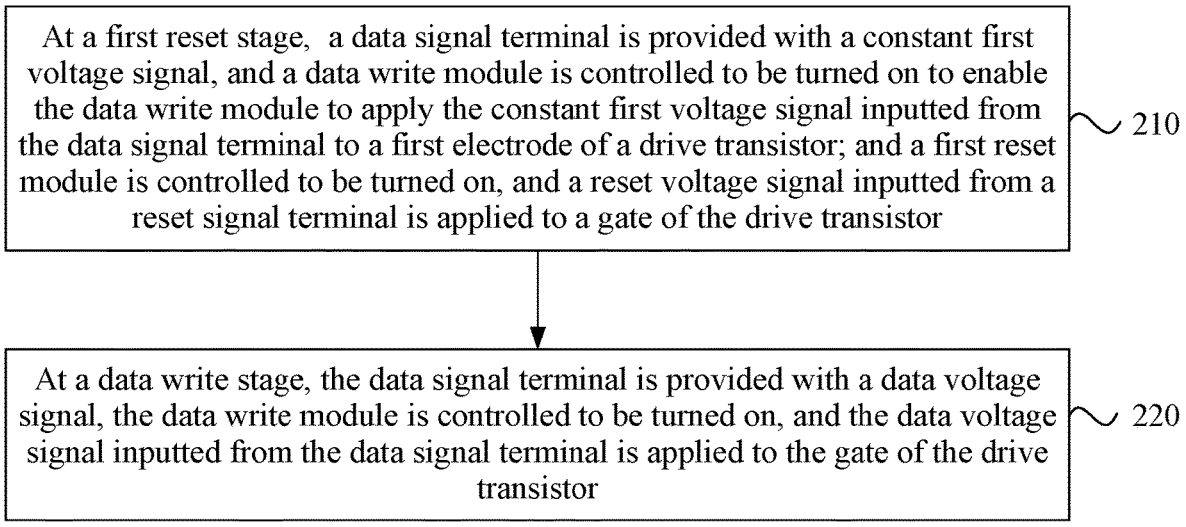
FIG. 10 is a flowchart of a drive method of a pixel circuit according to an embodiment of the present application.

An embodiment of the present application further provides a driving method of a pixel circuit. The driving method may be applied to the pixel circuit provided in any one of the above embodiments of the present application. FIG. 10 is a flowchart of a drive method of a pixel circuit according to an embodiment of the present application. With reference to FIG. 10, the driving method of a pixel circuit includes the steps described below.

In step 210, at a first reset stage, a data signal terminal is provided with a constant first voltage signal, and a data write module is controlled to be turned on to enable the data write module to apply the constant first voltage signal inputted from the data signal terminal to a first electrode of a drive transistor; and a first reset module is controlled to be turned on, and a reset voltage signal inputted from a reset signal terminal is applied to a gate of the drive transistor.

In step 220, at a data write stage, the data signal terminal is provided with a data voltage signal, the data write module is controlled to be turned on, and the data voltage signal inputted from the data signal terminal is applied to the gate of the drive transistor.

In the driving method of a pixel circuit provided by the embodiment of the present application, at the first reset stage and the data write stage, the data signal terminal is provided with a constant first voltage signal and a data voltage signal, respectively. At the first reset stage, the data write module applies the constant first voltage signal to the first electrode of the drive transistor, and at the first reset stage, the first reset module applies the reset voltage signal inputted from the reset signal terminal to the gate of the drive transistor, that is, at the first reset stage, the first voltage signal inputted from the data signal terminal serves as the reset signal of the first electrode of the drive transistor, and the reset voltage signal inputted from the reset signal terminal serves as the reset signal of the gate of the drive transistor. Accordingly, with the data write module and the first reset module controlled turned on in the pixel circuit at the first reset stage, the first voltage signal can be transmitted to the first electrode of the drive transistor, and the reset voltage signal can be transmitted to the gate of the drive transistor, and thus the drive transistor is fully reset at the first reset stage. In this way, when grayscale switching is performed in different frames, no matter what grayscale was displayed in the previous frame, at the first reset stage of the current frame, the drive transistor will be restored to the same initial state, and then the trapping and releasing of carriers in the active layer, the gate insulating layer, and the interface between the active layer and the gate insulating layer of the drive transistor tend to be consistent during the grayscale switching process. Therefore, when different grayscales are switched to the same grayscale, the drive transistor can generate the same drive current, and the brightness of the light-emitting module is basically the same, thereby reducing the afterimage and improving the display effect.

In some embodiments, on the basis of the above technical solution, the driving method of a pixel circuit further includes a step in which at the first reset stage, a second reset module is controlled to be turned on, and the reset voltage signal inputted from the reset signal terminal is applied to the second electrode of the drive transistor.

In some embodiments, on the basis of the above technical solution, with reference to FIG. 2, the pixel circuit includes a data write module 110, a second reset module 120, a first reset module 130, a drive transistor DT, and a light-emitting module 140. In some embodiments, the data write module 110 includes a write transistor T1 and a compensation transistor T2. The gate of the write transistor T1 is electrically connected with the first scan signal terminal Scan1, the first electrode of the write transistor T1 is electrically connected with the data signal terminal Vdata, and the second electrode of the write transistor T1 is electrically connected with the first electrode of the drive transistor DT. The gate of the compensation transistor T2 is electrically connected with the first scan signal terminal Scan1, the first electrode of the compensation transistor T2 is electrically connected with the second electrode of the drive transistor DT, and the second electrode of the compensation transistor T2 is electrically connected with the gate of the drive transistor DT. The control terminal of the second reset module 120 is electrically connected with the second scan signal terminal Scan2, the first terminal of the second reset module 120 is electrically connected with the reset signal terminal Vref, and the second terminal of the second reset module 120 is electrically connected with the second electrode of the drive transistor DT. The control terminal of the first reset module 130 is electrically connected with the third scan signal terminal Scan3, the first terminal of the first reset module 130 is electrically connected with the reset signal terminal Vref, and the second terminal of the first reset module 130 is electrically connected with the gate of the drive transistor DT.

At the first reset stage, the data signal terminal is provided with the constant first voltage signal, the data write module is controlled to be turned on to enable the data write module to apply the constant first voltage signal inputted from the data signal terminal to the first electrode of the drive transistor, the first reset module is controlled to be turned on, and the reset voltage signal inputted from the reset signal terminal is applied to the gate of the drive transistor. The above method specifically includes the steps described below.

At the first reset stage, the first scan signal terminal, the second scan signal terminal, and the third scan signal terminal are provided with turn-on control signals. The write transistor and the compensation transistor of the data write module are turned on in response to the turn-on control signal at the first scan signal terminal, and the constant first voltage signal inputted from the data signal terminal is applied to the first electrode of the drive transistor through the write transistor. The second reset module is turned on in response to the turn-on control signal inputted from the second scan signal terminal, and the reset voltage signal inputted from the reset signal terminal is applied to the second electrode of the drive transistor through the second reset module. The first reset module is turned on in response to the turn-on control signal inputted from the third scan signal terminal, and the reset voltage signal inputted from the reset signal terminal is applied to the gate of the drive transistor through the first reset module.

At the data write stage, the data signal terminal is provided with the data voltage signal, the data write module is controlled to be turned on, and the data voltage signal inputted from the data signal terminal is applied to the gate of the drive transistor. The above method specifically includes the steps described below.

At the data write stage, the data signal terminal is provided with a data signal, a turn-on control signal is inputted to the first scan signal terminal, the write transistor and the compensation transistor are turned on in response to the turn-on control signal at the first scan signal terminal, and the data voltage signal inputted from the data signal terminal is applied to the gate of the drive transistor through the write transistor, the drive transistor, and the compensation transistor.

The on or off state of the data write module, the second reset module, and the first reset module in the pixel circuit is controlled by signals inputted to the first scan signal terminal, the second scan signal terminal, and the third scan signal terminal, thereby achieving the full reset of the drive transistor at the first reset stage and the writing of the data voltage signal at the data write stage.

With reference to FIG. 8, the pixel circuit includes a data write module 110, a second reset module 120, a first reset module 130, a drive transistor DT, and a light-emitting module 140. In some embodiments, the data write module 110 includes a write transistor T1 and a compensation transistor T2. The gate of the write transistor T1 is electrically connected with the first scan signal terminal Scan1, the first electrode of the write transistor T1 is electrically connected with the data signal terminal Vdata, and the second electrode of the write transistor T1 is electrically connected with the first electrode of the drive transistor DT. The gate of the compensation transistor T2 is electrically connected with the second scan signal terminal Scan2, the first electrode of the compensation transistor T2 is electrically connected with the second electrode of the drive transistor DT, and the second electrode of the compensation transistor T2 is electrically connected with the gate of the drive transistor DT. The control terminal of the second reset module 120 is electrically connected with the third scan signal terminal Scan3, the first terminal of the second reset module 120 is electrically connected with the reset signal terminal Vref, and the second terminal of the second reset module 120 is electrically connected with the second electrode of the drive transistor DT. The second reset module 120 and the compensation transistor T2 form the first rest module 130.

At the first reset stage, the data signal terminal is provided with the constant first voltage signal, the data write module is controlled to be turned on to enable the data write module to apply the constant first voltage signal inputted from the data signal terminal to the first electrode of the drive transistor, the first reset module is controlled to be turned on, and the reset voltage signal inputted from the reset signal terminal is applied to the gate of the drive transistor. The above method specifically includes the steps described below.

At the first reset stage, the first scan signal terminal, the second scan signal terminal, and the third scan signal terminal are provided with turn-on control signals. The write transistor is turned on in response to the turn-on control signal at the first scan signal terminal, the compensation transistor is turned on in response to the turn-on control signal at the second scan signal terminal, and the constant first voltage signal inputted from the data signal terminal is applied to the first electrode of the drive transistor through the write transistor. The second reset module is turned on in response to the turn-on control signal inputted from the third scan signal terminal, and the reset voltage signal inputted from the reset signal terminal is applied to the second electrode of the drive transistor through the second reset module. The reset voltage signal inputted from the reset signal terminal is applied to the gate of the drive transistor through the second reset module and the compensation transistor.

At the data write stage, the data signal terminal is provided with the data voltage signal, the data write module is controlled to be turned on, and the data voltage signal inputted from the data signal terminal is applied to the gate of the drive transistor. The above method specifically includes the steps described below.

At the data write stage, the data signal terminal is provided with a data signal, a turn-on control signal is inputted to the first scan signal terminal, the write transistor and the compensation transistor are turned on in response to the turn-on control signal at the first scan signal terminal, and the data voltage signal inputted from the data signal terminal is applied to the gate of the drive transistor through the write transistor, the drive transistor, and the compensation transistor.

The on or off state of the data write module, the second reset module, and the first reset module in the pixel circuit is controlled by signals inputted to the first scan signal terminal, the second scan signal terminal, and the third scan signal terminal, thereby achieving the full reset of the drive transistor at the first reset stage and the writing of the data voltage signal at the data write stage.

The pixel circuit provided in this embodiment further includes a first light emission control module and a second light emission control module. The control terminal of the first light emission control module is electrically connected with the first light emission control signal terminal, the first terminal of the first light emission control module is electrically connected with the first supply voltage terminal, and the second terminal of the first light emission control module is electrically connected with the first electrode of the drive transistor. The control terminal of the second light emission control module is electrically connected with the second light emission control signal terminal, the first terminal of the second light emission control module is electrically connected with the second electrode of the drive transistor, the second terminal of the second light emission control module is electrically connected with the first terminal of the light-emitting module, and the second terminal of the light-emitting module is electrically connected with the second supply voltage terminal. The driving method of a pixel circuit further includes a step in which at the first reset stage and the data write stage, the first light emission control signal terminal and the second light emission control signal terminal are provided with turn-off control signals to turn off the first light emission control module and the second light emission control module at the first reset stage and the data write stage.

Figure 11:
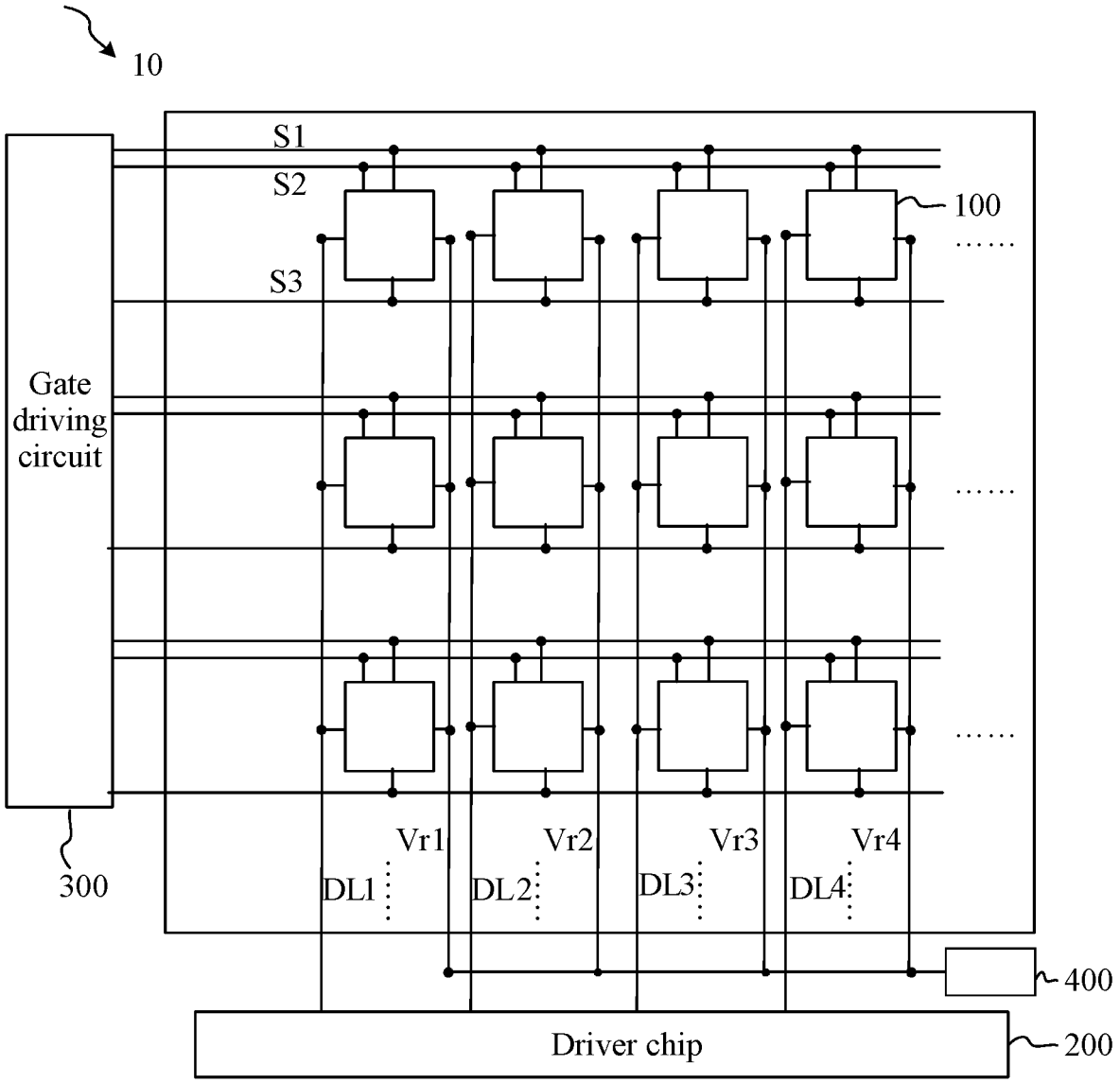
FIG. 11 is a structure view of a display device according to an embodiment of the present application.

An embodiment of the present application further provides a display device. FIG. 11 is a structural view of a display device according to an embodiment of the present application. With reference to FIG. 11, the display device 10 includes the pixel circuit 100 provided in any one of the above embodiments of the present application and further includes a driver chip 200 and a plurality of data lines (DL1, DL2, DL3, DL4, and so on). Each data line is connected with at least one column of pixel circuits 100. The driver chip 200 is configured to output a constant first voltage signal to each of the plurality of data lines at the first reset stage and output a data voltage signal to each of the plurality of data lines at the data write stage. In some embodiments, each data line is connected with one column of pixel circuits, and the data line is electrically connected with the data signal terminal of the pixel circuit.

In some embodiments, with reference to FIG. 11, the pixel circuit further includes a gate driving circuit 300, a plurality of scan lines (S1, S2, S3, and so on), a plurality of reset signal lines (Vr1, Vr2, Vr3, Vr4, and so on), and a reference voltage source 400. Each of the plurality of scan lines is electrically connected with an output terminal of the gate driving circuit. For example, in the pixel circuit shown in FIG. 2, each row of pixel circuits may be connected with three scan lines (referred to as, for example, a first scan line, a second scan line, and a third scan line), the first scan line is connected with the first scan signal terminals of the pixel circuits, the second scan line is connected with the second scan signal terminals of the pixel circuits, and the third scan line is connected with the third scan signal terminals of the pixel circuits. The plurality of reset signal lines are electrically connected with the reference voltage source 400. In some embodiments, the reference voltage source 400 may be disposed separately from the driver chip 200 or integrated inside the driver chip 200, which is not limited in this embodiment. Each reset signal line may be connected with reset signal terminals of one column of pixel circuits.

The display device provided in this embodiment includes the pixel circuit provided by any one of the embodiments of the present application. The driver chip outputs a constant first voltage signal to the data line at the first reset stage and outputs a data voltage signal to the data line at the data write stage. In this way, the pixel circuit is provided with the reset signal of the first electrode of the drive transistor through the data signal terminal, and then the second electrode and the gate of the drive transistor are respectively reset in cooperation with the second reset module and the first reset module in the pixel circuit, thereby achieving the full reset of the drive transistor and facilitating the improvement of the afterimage.

What is claimed is:

1. A pixel circuit, comprising:

a drive transistor;

a light-emitting module coupled to the drive transistor;

a data write module, which is configured to apply a constant first voltage signal inputted from a data signal terminal to a first electrode of the drive transistor at a first reset stage and apply a data voltage signal inputted from the data signal terminal to a gate of the drive transistor at a data write stage;

a first reset module, which is configured to apply a reset voltage signal inputted from a reset signal terminal to the gate of the drive transistor at the first reset stage; and a second reset module, which is configured to apply the reset voltage signal inputted from the reset signal terminal to a second electrode of the drive transistor at the first reset stage.

2. The pixel circuit according to claim 1, wherein the data write module comprises a write transistor and a compensation transistor, wherein the write transistor is configured to control a connection state between the data signal terminal and the first electrode of the drive transistor according to a signal of a first scan signal terminal, and the compensation transistor is configured to control a connection state between the second electrode of the drive transistor and the gate of the drive transistor according to the signal of the first scan signal terminal;

a control terminal of the second reset module is electrically connected with a second scan signal terminal, a first terminal of the second reset module is electrically connected with the reset signal terminal, and a second terminal of the second reset module is electrically connected with the second electrode of the drive transistor; and a control terminal of the first reset module is electrically connected with a third scan signal terminal, a first terminal of the first reset module is electrically connected with the reset signal terminal, and a second terminal of the first reset module is electrically connected with the gate of the drive transistor.

3. The pixel circuit according to claim 2, further comprising a first light emission control module, a second light emission control module, and a storage module, wherein the first light emission control module is configured to control a connection state between a first supply voltage terminal and the first electrode of the drive transistor according to a signal of a first light emission control signal terminal;

the second light emission control module is configured to control a connection state between the second electrode of the drive transistor and a first terminal of the light-emitting module according to a signal of a second light emission control signal terminal, and a second terminal of the light-emitting module is electrically connected with a second supply voltage terminal;

the first light emission control module is further configured to be turned off under the control of the signal of the first light emission control signal terminal at the first reset stage and the data write stage, and the second light emission control module is further configured to be turned off under the control of the signal of the second light emission control signal terminal at the first reset stage and the data write stage; and the storage module is configured to store a gate voltage of the drive transistor.

4. The pixel circuit according to claim 1, wherein the data write module comprises a write transistor and a compensation transistor, wherein the write transistor is configured to control a connection state between the data signal terminal and the first electrode of the drive transistor according to a signal of a first scan signal terminal, and the compensation transistor is configured to control a connection state between the second electrode of the drive transistor and the gate of the drive transistor according to a signal of a second scan signal terminal; and a control terminal of the second reset module is electrically connected with a third scan signal terminal, a first terminal of the second reset module is electrically connected with the reset signal terminal, and a second terminal of the second reset module is electrically connected with the second electrode of the drive transistor, wherein the first reset module comprises the second reset module and the compensation transistor.

5. The pixel circuit according to claim 4, further comprising a first light emission control module, a second light emission control module, and a third reset module;

wherein the first light emission control module is configured to control a connection state between a first supply voltage terminal and the first electrode of the drive transistor according to a signal of a light emission control signal terminal;

the second light emission control module is configured to control a connection state between the second electrode of the drive transistor and a first terminal of the light-emitting module according to the signal of the light emission control signal terminal, and a second terminal of the light-emitting module is electrically connected with a second supply voltage terminal; and the third reset module is configured to control a connection state between the reset signal terminal and the first terminal of the light-emitting module according to a signal of the third scan signal terminal; and the third reset module is further configured to be turned on under the control of the signal of the third scan signal terminal at the first reset stage to reset the first terminal of the light-emitting module.

6. The pixel circuit according to claim 5, wherein a control terminal of the first light emission control module is electrically connected with the light emission control signal terminal, a first terminal of the first light emission control module is electrically connected with the first supply voltage terminal, and a second terminal of the first light emission control module is electrically connected with the first electrode of the drive transistor; a control terminal of the second light emission control module is electrically connected with the light emission control signal terminal, a first electrode of the second light emission control module is electrically connected with the second electrode of the drive transistor, and a second terminal of the second light emission control module is electrically connected with the first terminal of the light-emitting module; and a control terminal of the third reset module is electrically connected with the third scan signal terminal, a first terminal of the third reset module is electrically connected with the reset signal terminal, and a second terminal of the third reset module is electrically connected with the first terminal of the light-emitting module.

7. The pixel circuit according to claim 5, wherein the first light emission control module comprises a first light emission control transistor, and the second light emission control module comprises a second light emission control transistor.

8. The pixel circuit according to claim 1, further comprising a first light emission control module, a second light emission control module, and a storage module, wherein the first light emission control module is configured to control a connection state between a first supply voltage terminal and the first electrode of the drive transistor according to a signal of a first light emission control signal terminal;

the second light emission control module is configured to control a connection state between the second electrode of the drive transistor and a first terminal of the light-emitting module according to a signal of a second light emission control signal terminal, and a second terminal of the light-emitting module is electrically connected with a second supply voltage terminal;

the first light emission control module is further configured to be turned off under the control of the signal of the first light emission control signal terminal at the first reset stage and the data write stage, and the second light emission control module is further configured to be turned off under the control of the signal of the second light emission control signal terminal at the first reset stage and the data write stage; and the storage module is configured to store a gate voltage of the drive transistor.

9. The pixel circuit according to claim 8, wherein the second reset module is further configured to be turned on under the control of a signal of a second scan signal terminal at a second reset stage, and the second light emission control module is further configured to be turned on under the control of the signal of the second light emission control signal terminal at the second reset stage, so that the reset voltage signal inputted from the reset signal terminal is applied to the first terminal of the light-emitting module through the second reset module and the second light emission control module; and the first light emission control module is further configured to be turned off under the control of the signal of the first light emission control signal terminal at the second reset stage;

wherein the second reset stage is between the first reset stage and the data write stage.

10. The pixel circuit according to claim 8, wherein a control terminal of the first light emission control module is electrically connected with the first light emission control signal terminal, a first terminal of the first light emission control module is electrically connected with the first supply voltage terminal, and a second terminal of the first light emission control module is electrically connected with the first electrode of the drive transistor; and a control terminal of the second light emission control module is electrically connected with the second light emission control signal terminal, a first terminal of the second light emission control module is electrically connected with the second electrode of the drive transistor, and a second terminal of the second light emission control module is electrically connected with the first terminal of the light-emitting module.

11. The pixel circuit according to claim 8, wherein the storage module comprises a storage capacitor, wherein one terminal of the storage capacitor is electrically connected with the first power supply voltage terminal, and the other terminal of the storage capacitor is electrically connected with the gate of the drive transistor.

12. The pixel circuit according to claim 1, wherein the first reset module comprises a second reset transistor.

13. The pixel circuit according to claim 1, wherein the second reset module comprises a first reset transistor.

14. A driving method of a pixel circuit, comprising:

at a first stage:

providing a data signal terminal with a constant first voltage signal, controlling a data write module to be turned on to enable the data write module to apply the constant first voltage signal inputted from the data signal terminal to a first electrode of a drive transistor, transistor;

controlling a first reset module to be turned on, and applying a reset voltage signal inputted from a reset signal terminal to a gate of the drive transistor, transistor; and controlling a second reset module to be turned on, and applying the reset voltage signal inputted from the reset signal terminal to a second electrode of the drive transistor; and at a data write stage:

providing the data signal terminal with a data voltage signal, controlling the data write module to be turned on, and applying the data voltage signal inputted from the data signal terminal to the gate of the drive transistor.

15. A display device comprising a pixel circuit, a driver chip and a plurality of data lines, wherein the pixel circuit comprises a drive transistor; a light-emitting module coupled to the drive transistor; a data write module, which is configured to apply a constant first voltage signal inputted from a data signal terminal to a first electrode of the drive transistor at a first reset stage and apply a data voltage signal inputted from the data signal terminal to a gate of the drive transistor at a data write stage; and a first reset module, which is configured to apply a reset voltage signal inputted from a reset signal terminal to the gate of the drive transistor at the first reset stage; and a second reset module, which is configured to apply the reset voltage signal inputted from the reset signal terminal to a second electrode of the drive transistor at the first reset stage, wherein each of the plurality of data lines is connected with at least one column of pixel circuits, and the driver chip is configured to output a constant first voltage signal to each of the plurality of data lines at a first reset stage and output a data voltage signal to each of the plurality of data lines at a data write stage.

16. The display device according to claim 15, further comprising: a gate driving circuit, a plurality of scan lines, a plurality of reset signal lines, and a reference voltage source; wherein each of the plurality of scan lines is electrically connected with an output terminal of the gate driving circuit, and each of the plurality of reset signal lines is electrically connected with the reference voltage source.

17. The display device according to claim 16, wherein each row of pixel circuits is connected with at least three scan lines, and the at least three scan lines comprise a first scan line, a second scan line, and a third scan line, respectively;

wherein the first scan line is connected with first scan signal terminals of the each row of pixel circuits, the second scan line is connected with second scan signal terminals of the each row of pixel circuits, and the third scan line is connected with third scan signal terminals of the each row of pixel circuits; and wherein the first scan signal terminals are used in both the first reset stage and the data write stage, the second scan signal terminals are used in the first reset stage, and the third scan signal terminals are used in the first reset stage.

18. The display device according to claim 16, wherein each of the plurality of reset signal lines is connected with reset signal terminals of a column of pixel circuits.

* * * * *